United States Patent [19]

Quiel

[11] Patent Number: 4,840,130

[45] Date of Patent: Jun. 20, 1989

[54] WASTE DISPOSAL SYSTEM

[75] Inventor: John M. Quiel, Long Beach, Calif.

[73] Assignee: Westinghouse Electric Corp., Pittsburgh, Pa.

[21] Appl. No.: 222,586

[22] Filed: Jul. 21, 1988

[51] Int. Cl.[4] ..... F23B 7/00

[52] U.S. Cl. ..... 110/234; 110/165 R; 110/246; 110/300; 110/314; 122/6 A; 432/116

[58] Field of Search ..... 110/246, 226, 234, 165 R, 110/165 A, 298, 300, 314; 122/6 A; 432/116

[56] References Cited

U.S. PATENT DOCUMENTS

| | | | |
|---|---|---|---|
| 1,319,700 | 10/1919 | Gould . | |
| 2,469,078 | 5/1945 | Robison . | |
| 3,822,651 | 7/1974 | Harris et al. . | |
| 4,066,024 | 1/1978 | O'Connor . | |
| 4,188,892 | 2/1980 | Kiefer et al. | 110/246 X |
| 4,226,584 | 10/1980 | Ishikawa . | |
| 4,437,418 | 3/1984 | Guillaume et al. . | |
| 4,528,917 | 7/1985 | Jacobs | 110/300 |
| 4,615,283 | 10/1986 | Ciliberti et al. . | |
| 4,699,070 | 10/1987 | O'Connor | 110/246 |
| 4,735,156 | 4/1988 | Johnson et al. | 110/246 |

FOREIGN PATENT DOCUMENTS

| | | | |
|---|---|---|---|
| 249034 | 7/1910 | Fed. Rep. of Germany | 110/246 |

*Primary Examiner*—Edward G. Favors

[57] ABSTRACT

A waste disposal system for the combustion of waste materials which includes a combustor having an inlet end and an outlet end with a furnace enclosing the outlet end. A step extends out from the back wall of the furnace which is spaced from and below the combustor outlet end. The step is hollow on the inside to form a plenum chamber to receive air and has an upper surface which defines a plurality of openings into the furnace whereby air injected through the openings deflects airborne ash and combustible solids from the outlet end of the combustor up into the furnace.

16 Claims, 2 Drawing Sheets

WASTE DISPOSAL SYSTEM

BACKGROUND OF THE INVENTION

1. Field of the Invention

The present invention is directed to a waste disposal system for the combustion of solid waste materials and, more particularly, to such a system that enhances the burnout of the waste materials by holding the particles in the combustion zone longer.

2. Description of the Related Art

Waste disposal systems for the combustion of waste materials have long been known. For example, numerous types of waste disposal combustion systems for solid waste materials have been employed for the disposal of municipal waste. Useful types of such disposal system are described in U.S. Pat. Nos. 3,822,651, 4,066,024 and 4,615,283. These types of waste disposal combustion systems utilize a rotary combustor or drum formed by a plurality of longitudinally extending pipes that form an inner cylindrical surface. The pipes are adapted to accommodate the flow of water therethrough to cool the walls of the combustor and produce steam. Air is charged to the combustor through various means and combustion gases from the unit passed to a boiler or furnace for further production of steam. Ash from the combusted material falls out of the outlet end of the combustor into an ash receiving chamber. These types of waste disposal combustion systems have been found very useful in waste disposal while providing revenue through generation of steam and electric power.

While such systems have proven useful in processing of solid waste materials such as municipal waste, the need still exists for a waste disposal system for the combustion of waste material which affords complete combustion of the waste materials while still being relatively simple, efficient and economical in operation.

SUMMARY OF THE INVENTION

It is an object of the present invention to provide a waste disposal system for the combustion of waste materials which deflects airborne ash and combustible solids from the outlet end of a combustor up into a furnace and ultimately to a final burnout device to enhance burnout of the combustible solids by holding the particles in the combustion zone longer.

It is a further object of the present invention to provide a waste disposal system for the combustion of waste materials which includes a step extending out into a furnace for supplying additional combustion air to the furnace and which also functions to block radiant heat in the furnace from being lost through the ash receiving chamber.

The invention achieves the above objects by providing a waste disposal system for the combustion of waste materials which includes a combustor having an inlet end and an outlet end, with a furnace enclosing the outlet end of the combustor. The furnace has a front wall through which the outlet end of the combustor extends and a back wall. The furnace preferably is a water wall furnace comprising tubes connected by webs which form the walls thereof. A step extends out from the back wall of the furnace as a continuation thereof which is spaced from and below the outlet end of the combustor. The step is hollow on the inside thereof to form a plenum chamber to receive air and has an upper surface slanted downwardly from the back wall. The upper surface defines a plurality of openings through the webs into the furnace whereby air injected through the openings deflects airborne ash and combustible solids from the outlet end of the combustor up into the furnace. Preferably the step extends between $\frac{1}{3}$ and $\frac{1}{2}$ of the distance across the depth of the furnace. Means are provided for supplying air under pressure to the plenum chamber and for preheating the air prior to it being supplied to the plenum chamber. The system further includes an ash receiving chamber at the bottom of the furnace with conveying means such as a grate conveyor in the chamber. Air injected through the openings in the upper surface of the step causes the airborne ash and combustible solids from the outlet end of the combustor to deflect up into the furnace and settle on the front of the conveying means, thereby facilitating greater burnout of the combustible solids prior to being discharged from the furnace.

These, together with other objects and advantages, which will be subsequently apparent, reside in the details of the construction and operation of the invention as more fully described and claimed hereafter, reference being made to the accompanying drawings forming a part hereof, wherein like numerals refer to like parts throughout.

DESCRIPTION OF THE PREFERRED EMBODIMENTS

Figure 1:
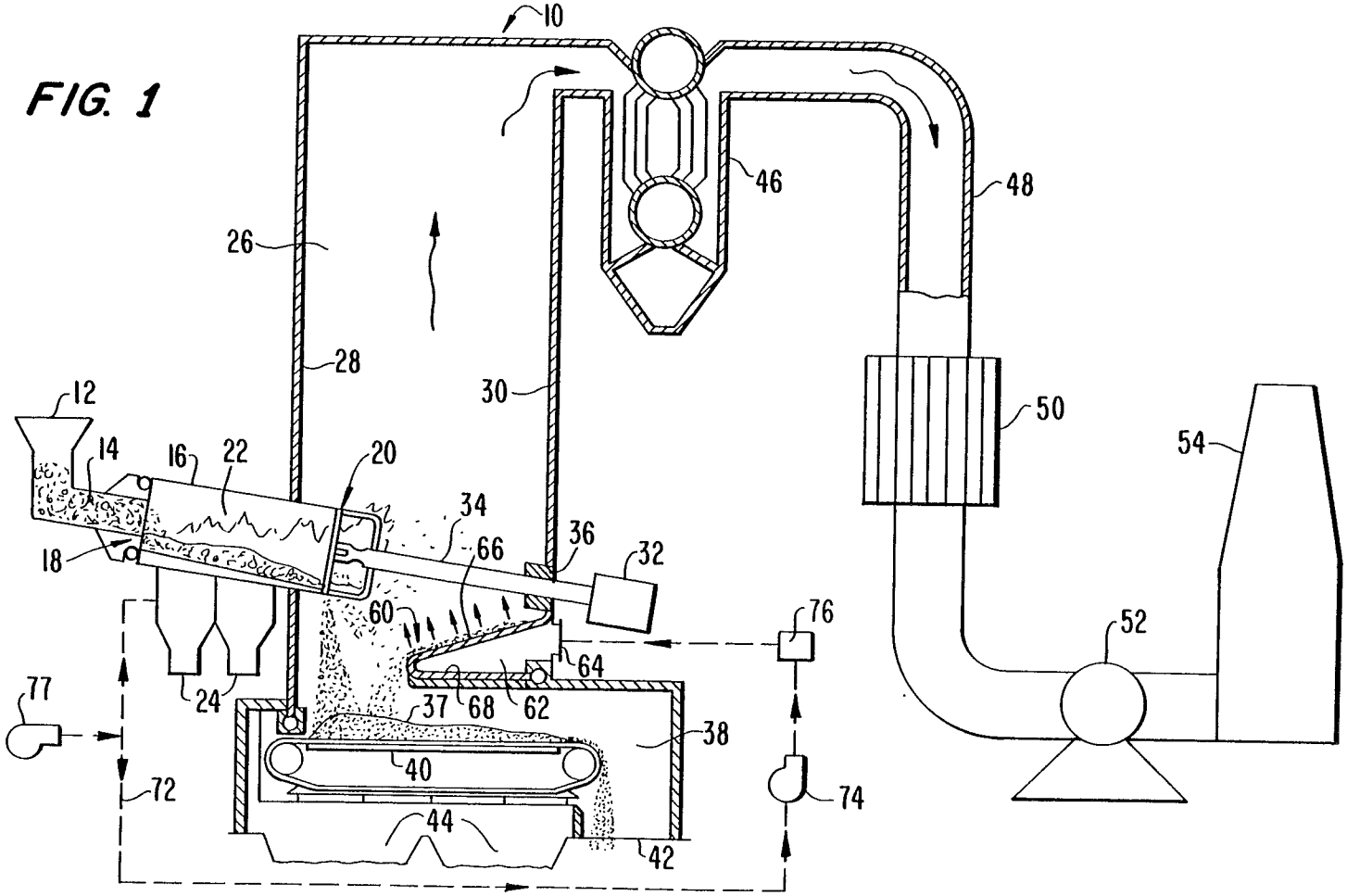
FIG. 1 is a schematic cross-sectional view of a waste disposal system for the combustion of waste materials according to the present invention.

Referring to the drawings, shown in FIG. 1 is a waste disposal system 10 for the combustion of waste materials according to the present invention. The system is useful in the combustion of solid fuel such as municipal waste.

The waste disposal system 10 includes a hopper 12 for receiving waste material 14 and feeding it to a combustor 16 wherein the waste material is incinerated inside of the combustor. A suitable combustor may comprise a rotary combustor 16 having an inlet end 18 and an outlet end 20 as shown in FIG. 1. The combustor 16 preferably is water cooled by tubes (not shown) which surround the combustion zone 22 of the combustor. Air for combustion is supplied through windboxes 24 associated with the combustor. The outlet end 20 of the combustor 16 is enclosed within a water wall furnace 26 having a front wall 28 and a back wall 30. A rotary joint 32 is provided that serves to feed water through a coaxial pipe or tube 34 to the tubes of the rotary combustor, and return a combination of hot water and steam for heat recovery, with a rotary seal 36 surrounding the pipe 34 in the back wall 30 of the furnace.

As the waste material 14 passes through the combustion zone 22 of the combustor 16, waste material is burned with the resulting ash 37 and other residue that is formed flowing from the discharge end 20 of the combustor into the lower end of the furnace 26 wherein it falls by gravity to an ash receiving chamber 38 having suitable conveying means 40 which conveys the ash and other residue to an ash discharge outlet 42. The conveying means 40 may be any suitable conveyor apparatus such as a traveling grate conveyor or a vibrating grate conveyor. Sifting hoppers 44 may be provided underneath the conveying means 40 to collect any material which falls through the conveying means.

The hot gases from the combustor 16 are discharged into the furnace 26 where they rise as shown by the arrows in FIG. 1, and are used to produce steam in a boiler bank 46 whereby the steam may be used as an appropriate energy source. The gases thereupon are passed through a conduit 48 to a feed water economizer 50 which removes additional heat from the gases after the gases have left the boiler bank. From the economizer, the gases then pass through the conduit 48 to an induction fan 52 and to a flue 54 for discharge to the atmosphere.

Figure 2:
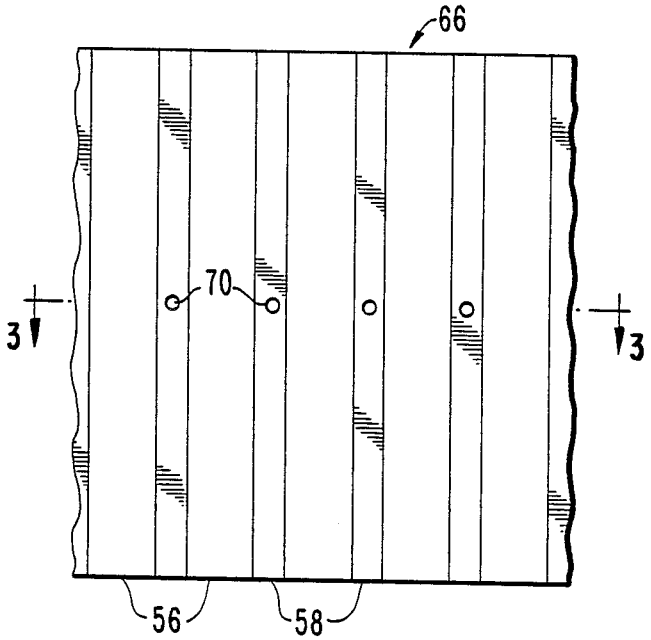
FIG. 2 is an enlarged top plan view of a portion of the upper surface of a step extending out from the back wall of the furnace and illustrating openings in the webs connecting the pipes which form part of the furnace wall.
Figure 3:
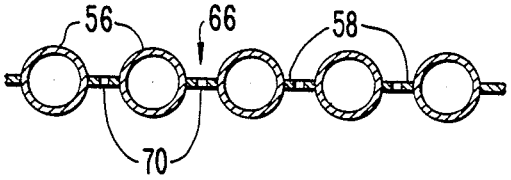
FIG. 3 is a cross-sectional view taken along line 3—3 of FIG. 2.

The furnace 26 is a water wall furnace comprised of tubes 56 connected by webs 58 as shown in FIGS. 2 and 3 which form part of the walls of the furnace. Water carried by the tubes 56 is heated by the hot combustion gases in the furnace 26.

A step 60 extends out from the back wall 30 in the lower portion of the furnace 26 and is spaced from and below the outlet end 20 of the combustor 16 as shown in FIG. 1. The step 60 is a continuation of the back wall and therefore contains the tubes 56 connected by the webs 58 as shown in FIGS. 2 and 3. The step 60 preferably extends between $\frac{1}{3}$ and $\frac{1}{2}$ of the distance across the depth of the furnace 26 and is hollow inside to form a plenum chamber 62 having access doors 64 on the back side thereof to provide access to the plenum chamber for cleaning and maintenance. The step 60 has an upper surface 66 which slopes downwardly from the back wall 30 of the furnace to its end point in the furnace from where its lower surface 68 extend back out parallel to the top of the ash receiver chamber 38. Preferable, surface 66 slopes downwardly at an angle of approximately 20° from the horizon.

As shown in FIGS. 2 and 3, the upper surface 66 of step 60 defines a plurality of openings 70 leading from the plenum chamber 62 into the interior of the furnace 26. The openings 70 are formed in the webs 58 connecting the tubes 56. The plenum chamber 62 is adapted to receive air under pressure from a suitable source whereby the air after entering the plenum chamber then exists out through the openings 70 in upper surface 66 into the interior of the furnace at a position spaced from and below the exit end 20 of the combustor 16 as shown by the arrows above the upper surface 66 in FIG. 1. Air under pressure may be supplied from a combustor air fan 77 and fed through appropriate lines 72 to the plenum chamber 62 as shown in FIG. 1. If necessary, a booster fan 74 may be used to provide sufficient pressure for the air. Preferably, an air heater 76 is employed to preheat the air prior to its introduction into the plenum chamber 62.

In operation of the waste disposal system according to the present invention, the waste material 14 is fed through hopper 12 into combustor 16 from where the ashes 37 fall by gravity through the lower portion of the furnace to the conveying means 40 in the ash receiving chamber 38. As the ash falls from the outlet end 20 of the combustor 16, the air under pressure introduced into the furnace from the plenum chamber 62 through the upper surface 66 of the step 60 deflects the gases of combustion and the airborne ash and other combustibles entrained therein up into the furnace and away from the back end of the conveying means 40 whereby the ash collects in greater quantities on the front end of the conveying means as shown in FIG. 1. When the ash and other combustible solids entrained in the gases of combustion are deflected upwardly, they have a further opportunity to combust, thus achieving greater combustion of the waste materials. In addition, by causing the ashes and other combustible solids which are not burned to be piled at the front of the conveying means, the combustible solids spend a longer resident time on the conveyor and thus achieve a better burnout prior to discharge through the ash discharge outlet 42. Accordingly, the step 60 of the present invention enhances burnout by holding the particles to be combusted in the combustion zone longer.

The step 60 further serves the additional function of blocking radiant heat loss to the ash combustion chamber since the step extends at least between $\frac{1}{3}$ and $\frac{1}{2}$ of the way across the depth of the furnace. The step 60 also provides tertiary air injected at high velocity right into the exhaust from the combustor thus enhancing mixing while reintroducing unburned combustibles that would otherwise escape burnout and exit the system. Accordingly, the overall efficiency and operation of the system is greatly improved.

The doors 64 provide a convenient means for access into the plenum chamber 62 inside of the step so that the chamber may be cleaned by any suitable means. Steam powered soot blowing nozzles may also be added to keep the upper surface of the step clean.

Numerous alterations and modifications of the structure herein disclosed will suggest themselves to those skilled in the art. It is to be understood, however, that the present disclosure relates to the preferred embodiments of the invention which is for purposes of illustration only and is not to be construed as a limitation of the invention. Also such modifications which do not depart from the spirit of the invention are intended to be included within the scope of the appended claims.

I claim:

1. A waste disposal system for the combustion of waste materials comprising:

a combustor having an inlet end and an outlet end;

a furnace enclosing the outlet end of said combustor, said furnace having a front wall through which said outlet end extends and a back wall; and a step extending out from said back wall spaced from and below said outlet end, said step being hollow on the inside thereof to form a plenum chamber to receive air and having an upper surface which defines a plurality of openings into said furnace whereby air injected through said openings deflects airborne ash and combustible solids from the outlet end of said combustor up into said furnace.

2. A system as recited in claim 1, wherein said step extends between one third and one half of the distance across the depth of said furnace.

3. A system as recited in claim 1, wherein said upper surface of said step slopes downwardly from said back wall.

4. A system as recited in claim 1, wherein said furnace is a water wall furnace comprising tubes connected by webs which form the walls of said furnace and whereby said step is formed as a continuation of said back wall with said openings being formed in said webs.

5. A system as recited in claim 1, which includes means for providing air under pressure to said plenum chamber.

6. A system as recited in claim 5, which includes means for preheating said air provided to said plenum chamber.

7. A system as recited in claim 1, which includes an ash receiving chamber at the bottom of said furnace and conveying means in said chamber and wherein said air injected through said openings in said step causes the airborne ash and combustible solids from said combustor to settle on the front of said conveying means.

8. A system as recited in claim 7, wherein said conveying means comprises a grate conveyor.

9. A system as recited in claim 1, which includes a door accessing said plenum chamber.

10. A waste disposal system for the combustion of waste materials comprising:

a combustor having an inlet end and an outlet end;

a furnace enclosing the outlet end of said combustor, said furnace having a front wall through which said outlet end extends and a back wall; said furnace being a water wall furnace comprising tubes connected by webs which form the walls of said furnace; and a step extending out from said back wall as a continuation thereof and spaced from and below said outlet end, said step being hollow on the inside thereof to form a plenum chamber to receive air and having an upper surface slanted downwardly from said back wall, said upper surface defining a plurality of openings through said webs into said furnace whereby air injected through said openings deflects airborne ash and combustible solids from said combustor up into said furnace.

11. A system as recited in claim 10, wherein said step extends between one third and one half of the distance across the depth of said furnace.

12. A system as recited in claim 10, which includes means for providing air under pressure to said plenum chamber.

13. A system as recited in claim 12, which includes means for preheating said air provided to said plenum chamber.

14. A system as recited in claim 10, which includes an ash receiving chamber at the bottom of said furnace and conveying means in said chamber and wherein said air injected through said openings in said step causes the airborne ash and combustible solids from said combustor to settle on the front of said conveying means.

15. A system as recited in claim 14, wherein said conveying means comprises a grate conveyor.

16. A system as recited in claim 10, which includes a door accessing said plenum chamber.

* * * * *